US011024951B2

(12) United States Patent
Nishikawa et al.

(10) Patent No.: US 11,024,951 B2
(45) Date of Patent: Jun. 1, 2021

(54) ANTENNA DEVICES

(71) Applicants: KOJIMA INDUSTRIES CORPORATION, Toyota (JP); TOYOTA JIDOSHA KABUSHIKI KAISHA, Toyota (JP)

(72) Inventors: Kazuyoshi Nishikawa, Toyota (JP); Keita Yamagishi, Toyota (JP); Shinobu Wakahara, Toyota (JP)

(73) Assignees: Kojima Industries Corporation; Toyota Jidosha Kabushiki Kaisha

( * ) Notice: Subject to any disclaimer, the term of this patent is extended or adjusted under 35 U.S.C. 154(b) by 811 days.

(21) Appl. No.: 15/647,046

(22) Filed: Jul. 11, 2017

(65) Prior Publication Data

US 2018/0034143 A1 Feb. 1, 2018

(30) Foreign Application Priority Data

Jul. 29, 2016 (JP) ..... JP2016-149134

(51) Int. Cl.
*H01Q 1/32* (2006.01)
*H01Q 1/42* (2006.01)
*H01Q 1/12* (2006.01)

(52) U.S. Cl.
CPC ..... *H01Q 1/3275* (2013.01); *H01Q 1/1207* (2013.01); *H01Q 1/1214* (2013.01); *H01Q 1/42* (2013.01)

(58) Field of Classification Search
CPC ..... H01Q 1/3275; H01Q 1/1207
See application file for complete search history.

(56) References Cited

U.S. PATENT DOCUMENTS

2007/0046551 A1* 3/2007 Tateno ..... H01Q 1/3275 343/713
2014/0125550 A1* 5/2014 Kaneko ..... H01Q 1/24 343/872

FOREIGN PATENT DOCUMENTS

JP 2005102031 A 4/2005
JP 2013229813 A 11/2013

OTHER PUBLICATIONS

Japanese Office Action dated Sep. 25, 2018, for Japanese Application No. 2016-149134 (4 p.)
English Translation of Japanese Office Action dated Sep. 25, 2018, for Japanese Application No. 2016-149134 (3 p.)

* cited by examiner

*Primary Examiner* — Dimary S Lopez Cruz
*Assistant Examiner* — Amal Patel
(74) *Attorney, Agent, or Firm* — Conley Rose, P.C.

(57) ABSTRACT

A vehicular antenna device includes an antenna unit transmitting and receiving various electromagnetic waves or signals, an antenna cover configured to cover the antenna unit, and a pad attached to an inner peripheral surface of the antenna cover. The antenna unit is attached to the antenna cover with the pad disposed therebetween. The pad includes a postural adjusting member formed therein. The postural adjusting member is configured to be elastically compressed in a condition in which the antenna device is attached to a roof of a vehicle.

3 Claims, 15 Drawing Sheets

ANTENNA DEVICES

CROSS-REFERENCE TO RELATED APPLICATIONS

This application claims priority to Japanese patent application number 2016-149134 filed Jul. 29, 2016, the contents of which are incorporated herein by reference in their entirety for all purposes.

STATEMENT REGARDING FEDERALLY SPONSORED RESEARCH OR DEVELOPMENT

Not applicable.

BACKGROUND

The disclosure relates generally to vehicular antenna devices. More specifically, the disclosure relates to vehicular shark fin antenna devices that are configured to be attached to a roof of a vehicle.

Generally, a vehicular antenna device is attached to a roof of a vehicle in order to increase the sensitivity of the antenna device. A known vehicular antenna device configured to be attached to the roof of the vehicle is taught, for example, by Japanese Laid-Open Patent Publication No. 2013-229813 (JP 2013-229813A). The antenna device may be referred to as a shark fin antenna. As shown in FIG. 9-11, the antenna device 103 includes an antenna unit 110 configured to transmit and receive various electromagnetic waves or signals, an antenna cover 130, and an elastomer pad 140 attached to an inner peripheral surface 130*b* of an opening periphery 130*a* of the antenna cover 130. The antenna unit 110 is attached to the antenna cover 130 with the elastomer pad 140 disposed therebetween. As shown in FIGS. 12 and 14, the antenna device 103 thus constructed is attached to the roof 102 of the vehicle 101 with the elastomer pad 140 positioned between the antenna cover 130 and the roof 102. The antenna device 103 (the shark fin antenna device) may have a simple structure and a good appearance compared with a (telescopic) rod antenna.

The antenna device 103 is attached to the roof 102 of the vehicle 101 at a predetermined position thereon. As shown in FIGS. 12 to 15, in order to attach the antenna device 103 to the roof 102, the antenna device 103 is positioned on the roof 102 while a threaded bore 122 formed in the antenna unit 110 is aligned with an attachment hole 102*a* previously formed in the roof 102. Subsequently, a fastening bolt 150 is inserted into the attachment hole 102*a* from an interior side of the roof 102 and is then screwed or threaded into the threaded bore 122. Thus, the antenna device 103 is attached to the roof 102.

SUMMARY

In one aspect of the disclosure, a vehicular antenna device may include an antenna unit transmitting and receiving various electromagnetic waves or signals, an antenna cover configured to cover the antenna unit, and a pad attached to an inner peripheral surface of the antenna cover. The antenna unit is attached to the antenna cover with the pad interleaved therebetween. The pad has a postural adjusting member formed therein. The postural adjusting member is arranged and constructed to be elastically compressed in a condition in which the antenna device is attached to a roof of a vehicle.

According to the aspect, when the antenna device is attached to the roof, the antenna cover (the antenna unit) may be posturally adjusted due to a restoring force of the compressed postural adjusting member. As a result, the antenna cover (the antenna unit) may be prevented from being partially spaced from the roof. That is, the antenna device may be attached to the roof without producing a clearance gap between the antenna cover and the roof. Therefore, the antenna device attached to the roof may have a good appearance.

Other objects, features and advantage of the present teaching will be readily understood after reading the following detailed description together with the accompanying drawings and the claims.

BRIEF DESCRIPTION OF THE DRAWINGS

For a detailed description of the preferred embodiments of the invention, reference will now be made to the accompanying drawings in which.

DETAILED DESCRIPTION

Figure 1:
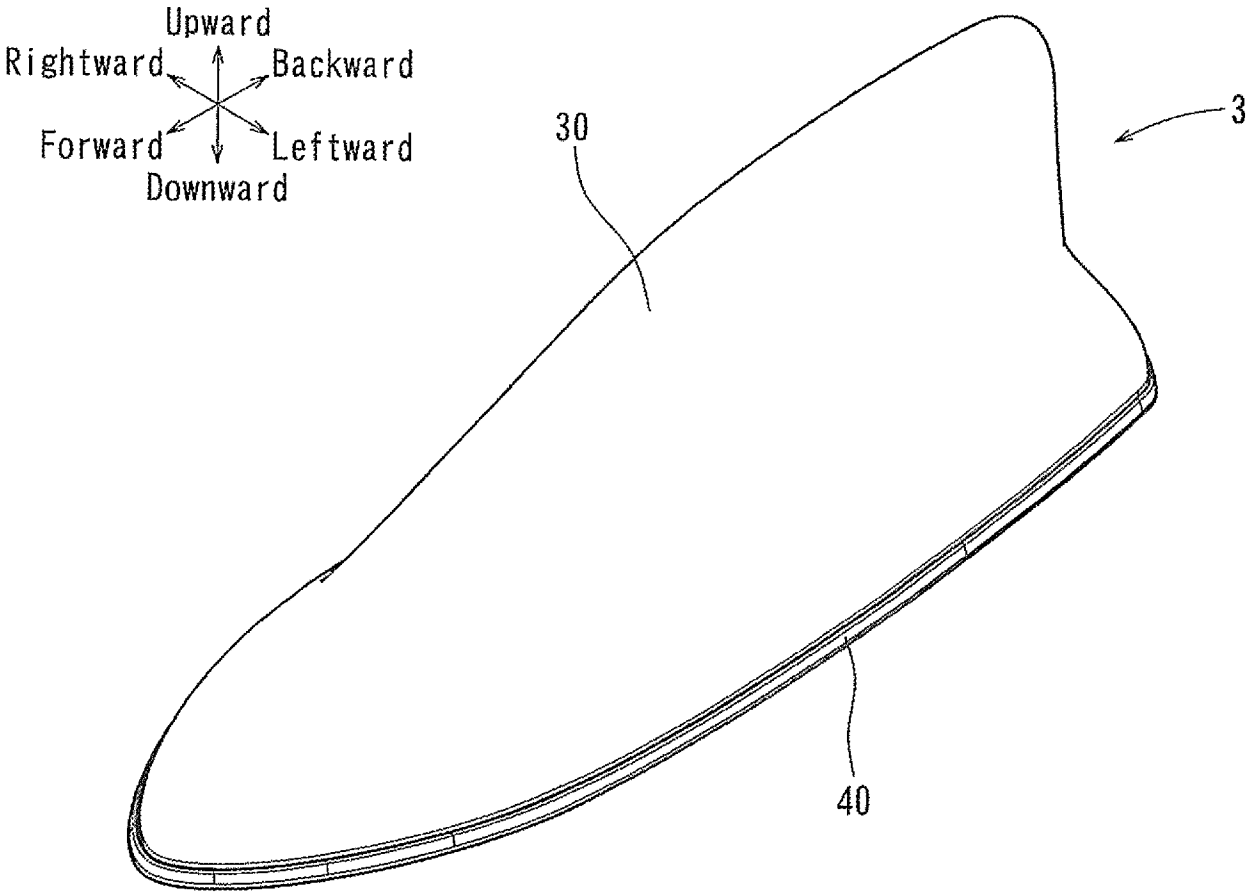
FIG. 1 is a perspective view of an antenna device according to a representative embodiment, which is viewed from above.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections.

Figure 15:
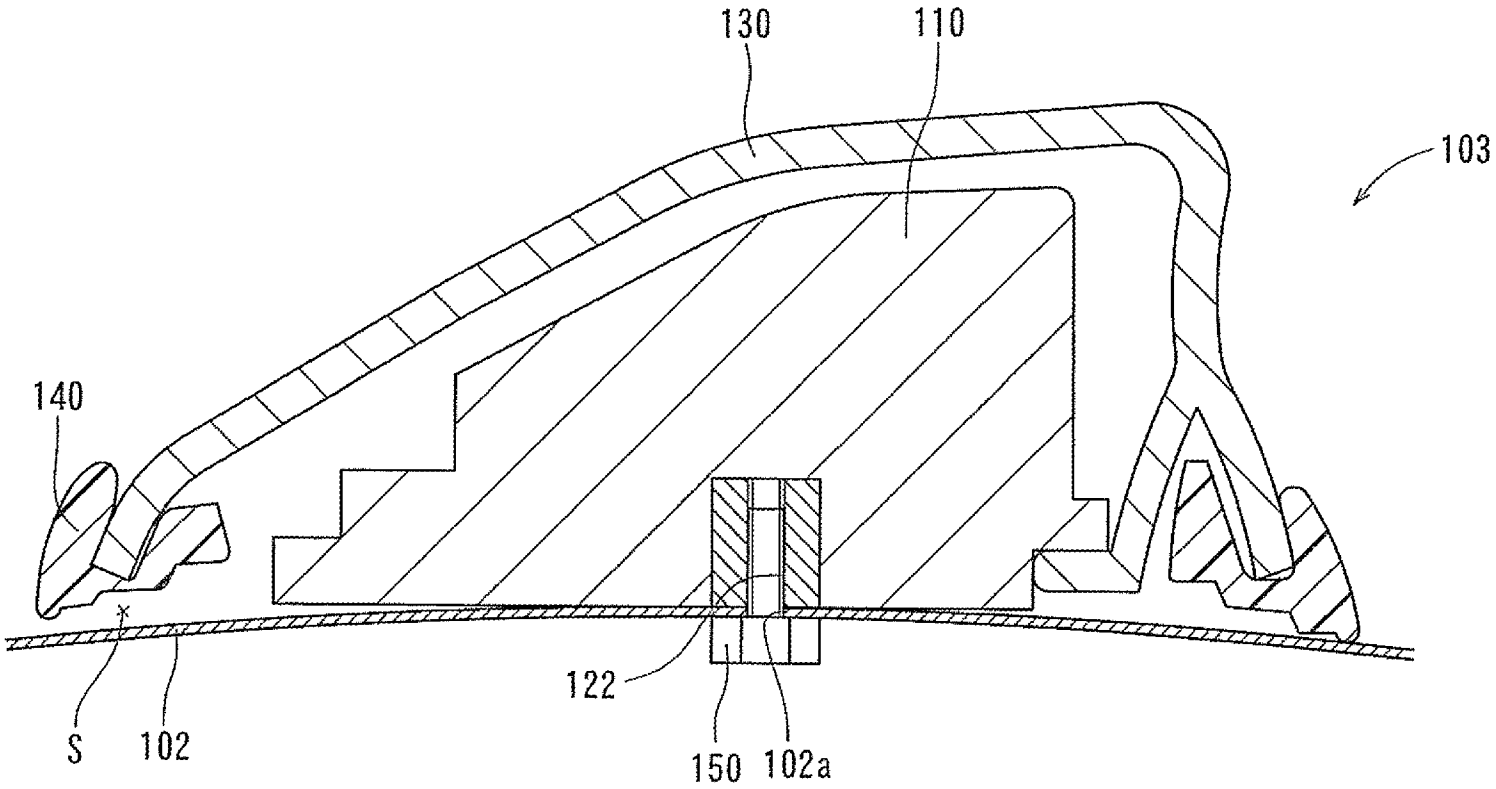
FIG. 15 PRIOR ART
FIG. 15 is a schematically enlarged vertical cross-sectional view of FIG. 14.

As previously described, the conventional antenna device 103 is attached to the roof 102 of the vehicle 101 with fastening bolt 150. Generally, the threaded bore 122 into which the fastening bolt 150 is threaded is not positioned on a longitudinal center of the antenna unit 110 and is offset backward therefrom. Therefore, as shown in FIG. 15, when the fastening bolt 150 is threaded into the threaded bore 122 (fastened) in order to attach the antenna device 103 to the roof 102, a rear portion of the antenna unit 110 (a rear portion of the antenna cover 130) may be relatively strongly pressed against the roof 102 (as compared to the front portion of the antenna cover 130). As a result, a front portion of the antenna cover 130 (a front portion of the antenna unit 110) may be spaced from the roof 102, so as to form a clearance gap S therebetween. Further, because the roof 102 has a low or limited rigidity, the roof 102 may be deformed or depressed when the fastening bolt 150 is fastened. As a result, the clearance gap S between the front portion of the antenna cover 130 and the roof 102 may be increased. Such a clearance gap S may lead to an inferior appearance of the antenna device 103 attached to the roof 102. Accordingly, there is a need in the art for an improved vehicular antenna device.

A representative embodiment will now be described in detail with reference to FIGS. 1 to 8.

Figure 12:
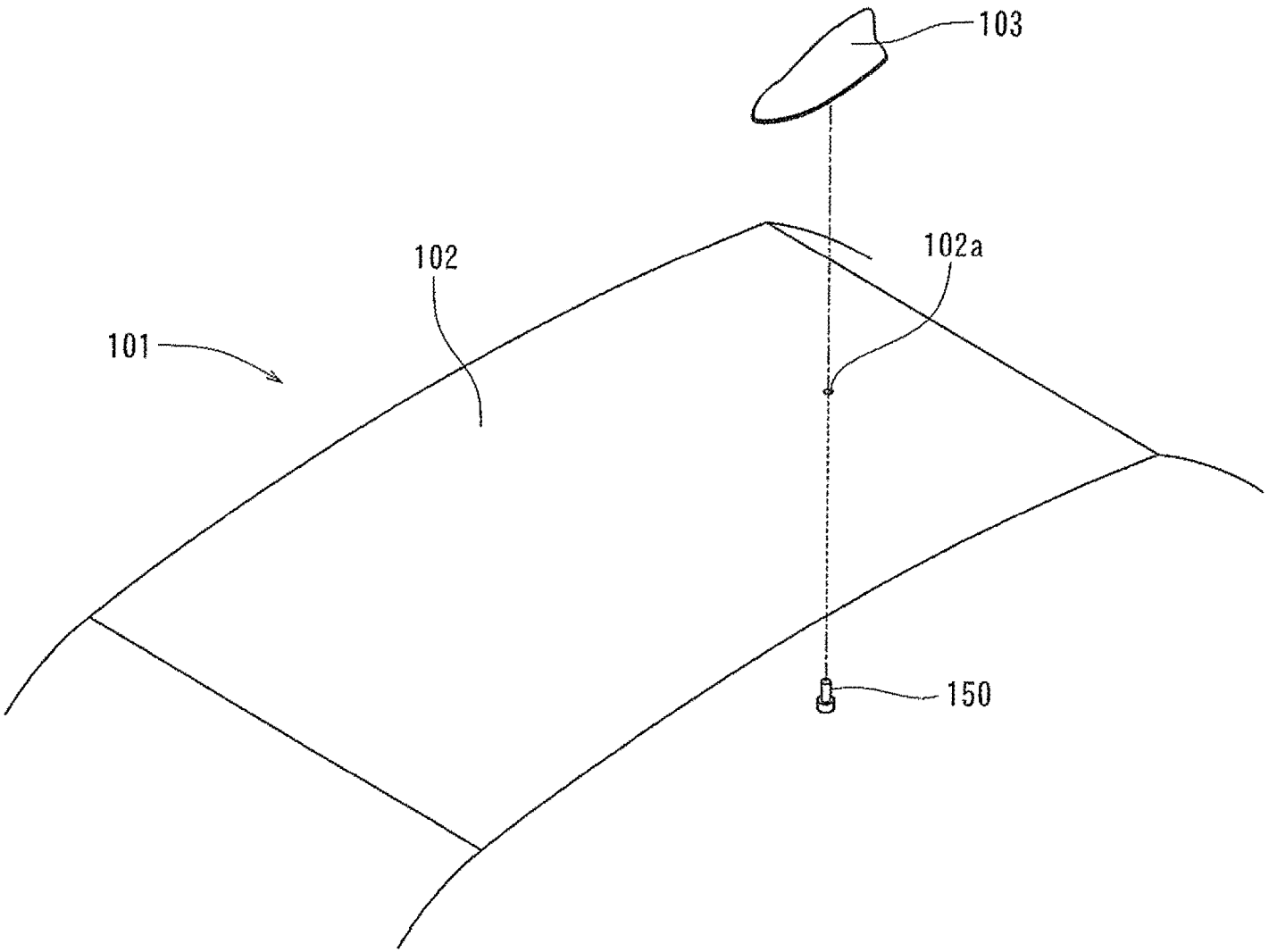
FIG. 12 PRIOR ART
FIG. 12 is a perspective view of the antenna device, which shows a method of attaching the antenna device to a roof of a vehicle.
Figure 13:
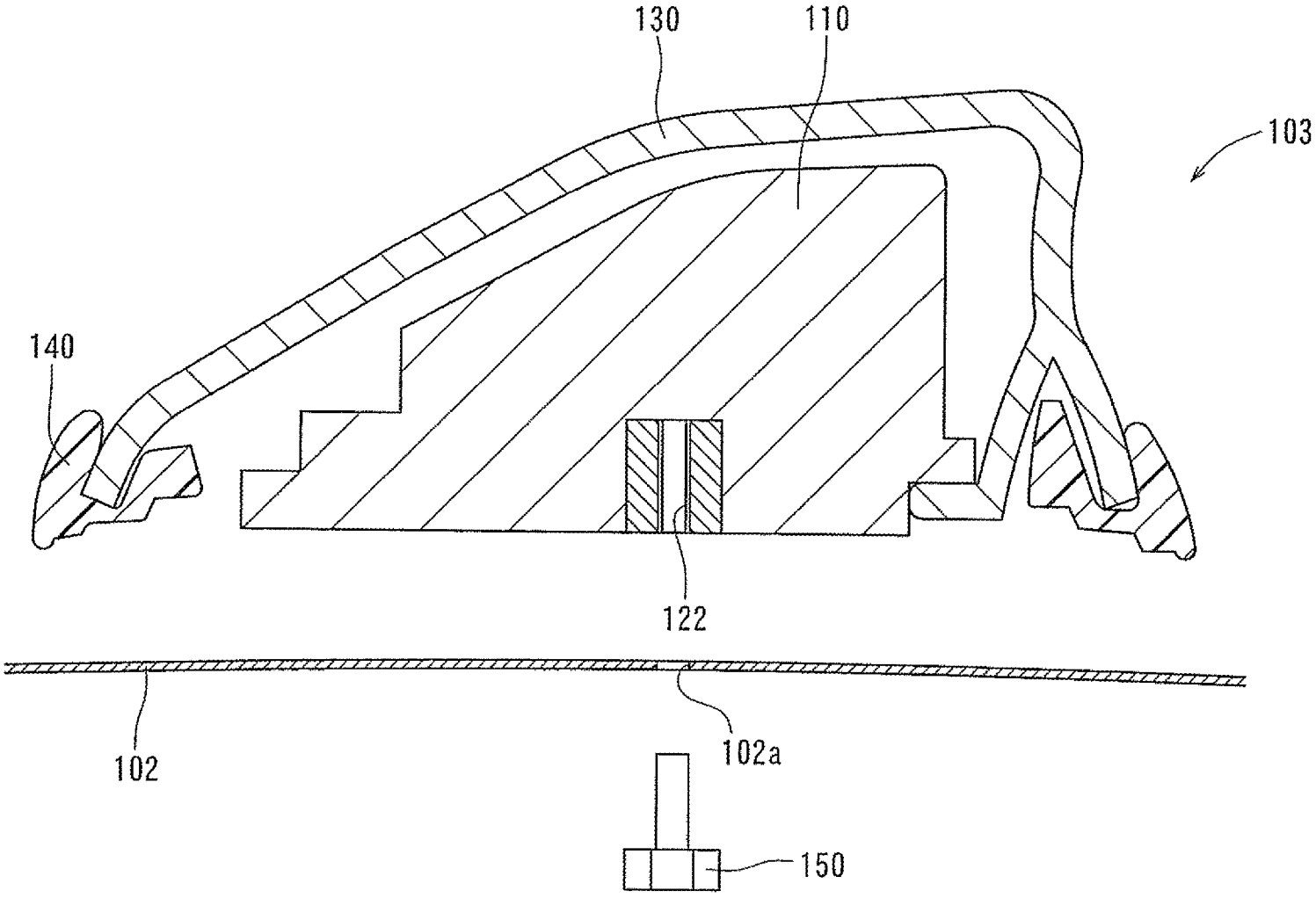
FIG. 13 PRIOR ART
FIG. 13 is a schematically enlarged vertical cross-sectional view of FIG. 12.
Figure 14:
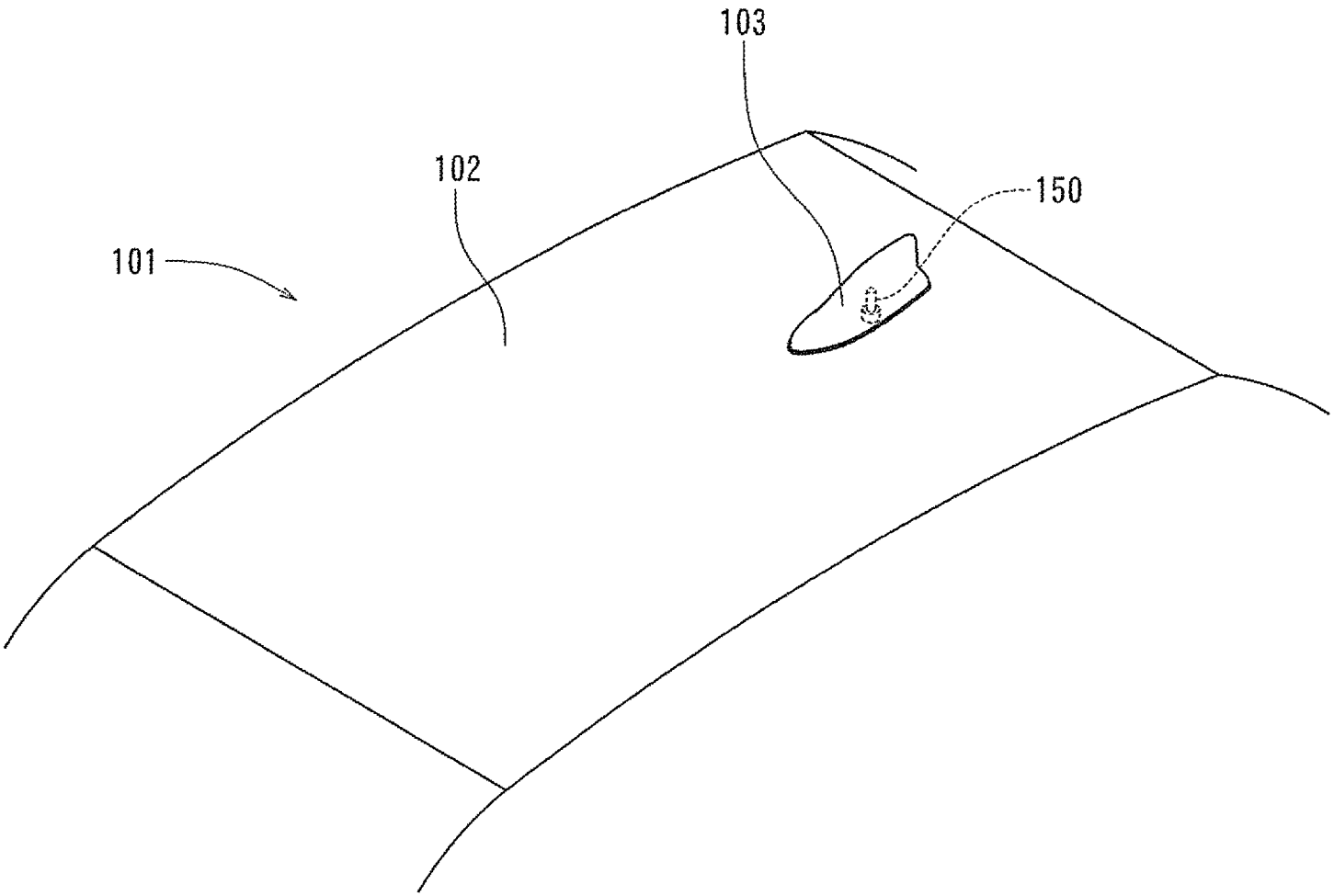
FIG. 14 PRIOR ART
FIG. 14 is a perspective view of the antenna device, which shows a condition in which the antenna device is attached to the roof of the vehicle.

In this embodiment, an automobile (passenger car) 1 may be exemplified as a vehicle to which a vehicular antenna device 3 according to the embodiment is attached (FIGS. 12 and 14). Further, forward and backward, rightward and leftward, and upward and downward in the drawings respectively correspond to forward and backward, rightward and leftward, and upward and downward of the automobile 1, which are identified in the drawings.

Figure 2:
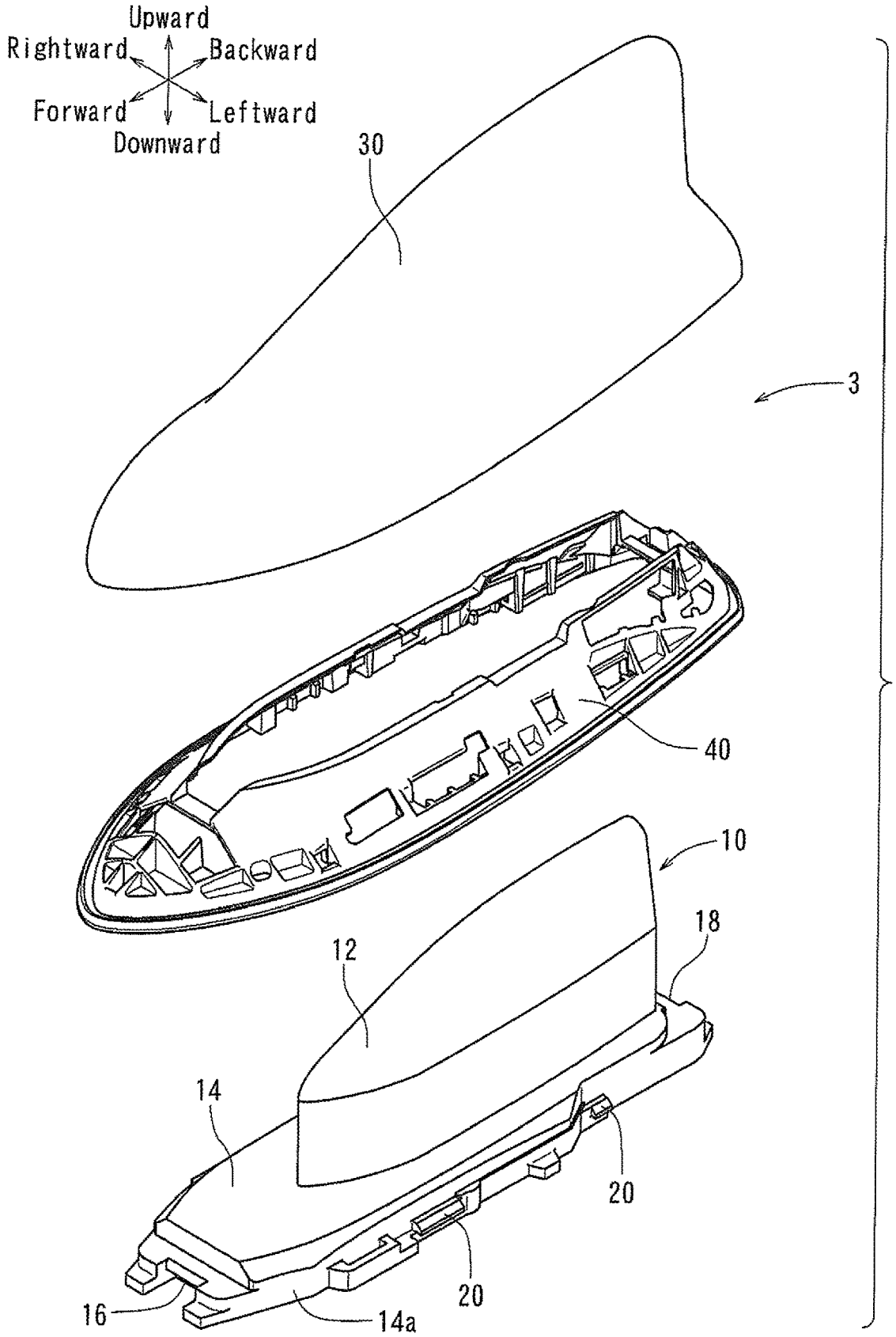
FIG. 2 is an exploded perspective view of the antenna device, which is viewed from above.
Figure 3:
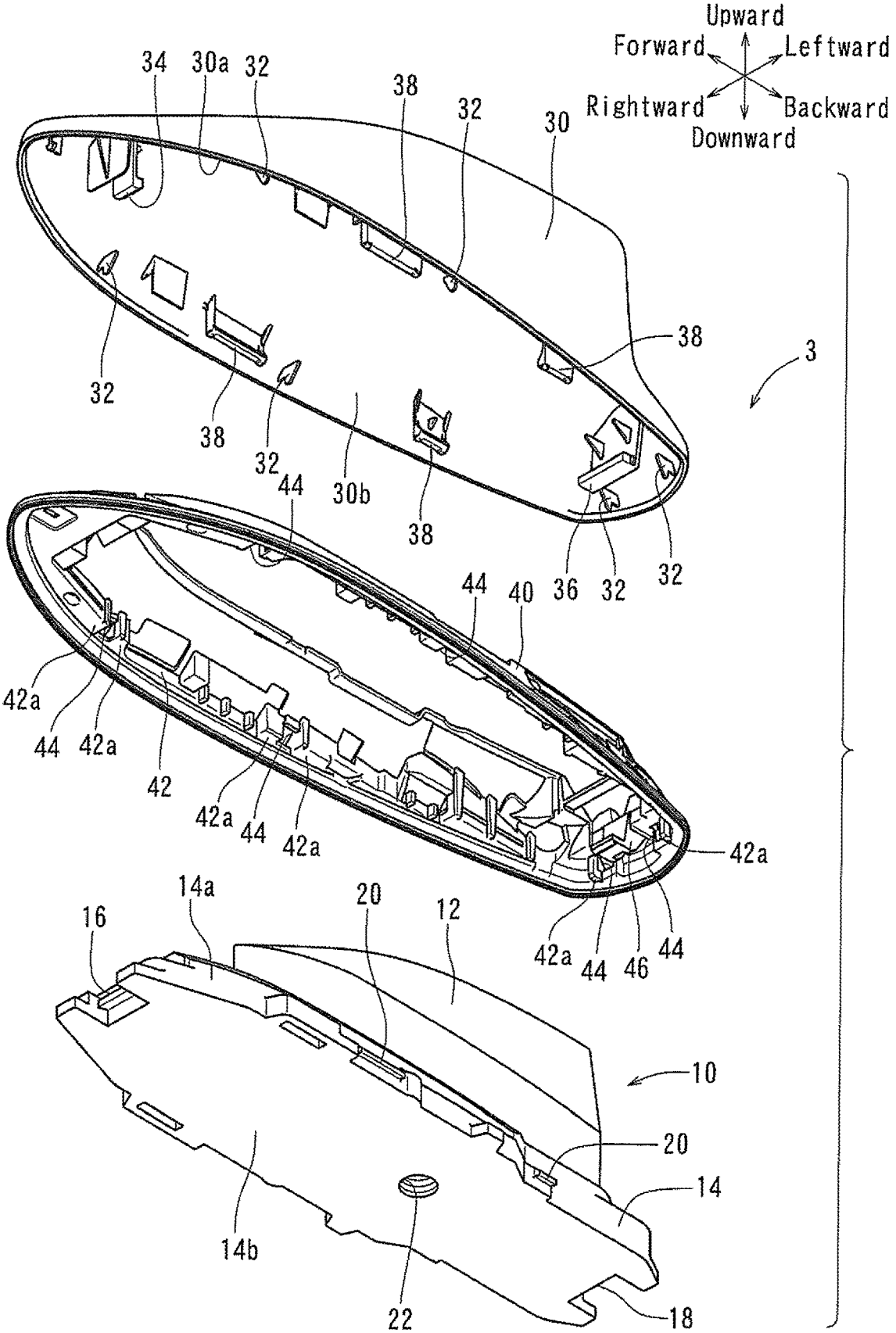
FIG. 3 is an exploded perspective view of the antenna device, which is viewed from below.

As shown in FIGS. 1 to 3, the vehicular antenna device 3 (which will be hereinafter simply referred to as the antenna device 3) includes an antenna unit 10, an antenna cover 30 and a pad 40. The antenna unit 10 may be composed of an antenna element 12 configured to transmit and receive various electromagnetic waves or signals (e.g., radio broadcasting signals, television broadcasting signals, GPS signals, cell-phone signals, signals from ETC device), and an antenna substrate 14 having various electrical circuits (not shown) electrically connected to the antenna element 12.

As shown in FIGS. 2 and 3, the antenna substrate 14 of the antenna unit 10 may have a main engagement portion 16 formed in a front side of an outer periphery 14*a* thereof. The antenna substrate 14 may also have an auxiliary engagement portion 18 formed in a back side of the outer periphery 14*a* thereof. The antenna substrate 14 may have two pairs of (front and back) engagement claws 20 respectively formed in lateral (right and left) sides of the outer periphery 14*a* thereof. Each pair of engagement claws 20 may be positioned at a certain interval in a front-back direction. Further, the antenna substrate 14 may have a threaded bore 22 formed therein, which may be used to attach the antenna device 3 to a roof 2 (FIGS. 5 and 7) of the automobile 1. The threaded bore 22 may be opened in a bottom surface (attaching surface) 14*b* of the antenna substrate 14. Further, the threaded bore 22 may be located at a position spaced backward from a longitudinal center of the antenna unit 10 (the antenna substrate 14). That is, the threaded bore 22 may not be positioned on the longitudinal center of the antenna unit 10 and may be offset backward therefrom.

As shown in FIG. 3, the antenna cover 30 may be a shark fin-shaped hollow member having an opening formed in a bottom portion thereof. That is, the antenna cover 30 may be an open-bottomed streamline-shaped hollow member that is gradually widened and raised front to back. The antenna cover 30 may have an internal space that is configured to receive or encapsulate the antenna unit 10.

As shown in FIG. 3, the antenna cover 30 may have an opening periphery 30*a* that defines the opening thereof. Further, the antenna cover 30 may have three (first to third) pairs of engagement strips 32 (which may also be referred to as first engagement elements) formed in an inner peripheral surface 30*b* of the opening periphery 30*a*. The first pair of engagement strips 32 may be formed in a back side of the inner peripheral surface 30*b*, so as to be positioned at a certain interval in a lateral direction. Each of the second and third pairs of engagement strips 32 may be formed in each of lateral (right and left) sides of the inner peripheral surface 30*b*, so as to be positioned at a certain interval in the front-back direction. Further, the antenna cover 30 may have a main engagement claw 34 formed in a front side of an interior surface thereof. The main engagement claw 34 may be arranged and constructed to flexibly engage the main engagement portion 16 of the antenna unit 10 when the antenna unit 10 is pressed into the antenna cover 30 (which will be hereinafter described).

As shown in FIG. 3, the antenna cover 30 may further have an engagement block 36 formed in a back side of the interior surface thereof. The engagement block 36 may be arranged and constructed to engage the auxiliary engagement portion 18 of the antenna unit 10 when the antenna unit 10 is pressed into the antenna cover 30. Further, the antenna cover 30 may have two pairs of (front and back) auxiliary engagement portions 38 formed in lateral (right and left) sides, respectively, of the interior surface thereof. Each pair of auxiliary engagement portions 38 may be arranged and constructed to engage the corresponding engagement claws 20 of the antenna unit 10 when the antenna unit 10 is pressed into the antenna cover 30. Further, the antenna cover 30 may preferably be integrally formed of hard or rigid synthetic resins.

As shown in FIG. 3, the pad 40 may have a substantially annular shape and may be configured to conform to the inner peripheral surface 30*b* of the opening periphery 30*a* of the antenna cover 30. The pad 40 may function as a sealing member between the antenna cover 30 and the roof 2 of the automobile 1 when the antenna device 3 is attached to the roof 2 (which will be hereinafter described). The pad 40 may preferably be integrally formed of soft or elastic synthetic resins (e.g., rubber or elastomer.

As shown in FIG. 3, the pad 40 may have three (first to third) pairs of (vertical) engagement slots 44 (which may also be referred to as second engagement elements) formed in a peripheral wall 42 thereof. Further, the engagement slots 44 may preferably be formed in the peripheral wall 42 of the pad 40 so as to be positioned between guide blocks 42*a* formed in an inner surface of the peripheral wall 42. The first pair of engagement slots 44 may be formed in a back side of the peripheral wall 42 of the pad 40. The first pair of engagement slots 44 may be arranged and constructed to engage the first pair of engagement strips 32 formed in the back side of the inner peripheral surface 30*b* of the antenna cover 30 when the pad 40 is fitted in the antenna cover 30 (which will be hereinafter described). Further, the second and third pairs of engagement slots 44 may respectively be formed in lateral (right and left) sides of the peripheral wall 42 of the pad 40. The second and third pairs of engagement slots 44 may be arranged and constructed to engage the second and third pairs of engagement strips 32, respectively, formed in the right and left sides of the inner peripheral surface 30*b* of the antenna cover 30 when the pad 40 is fitted in the antenna cover 30.

Figure 4:
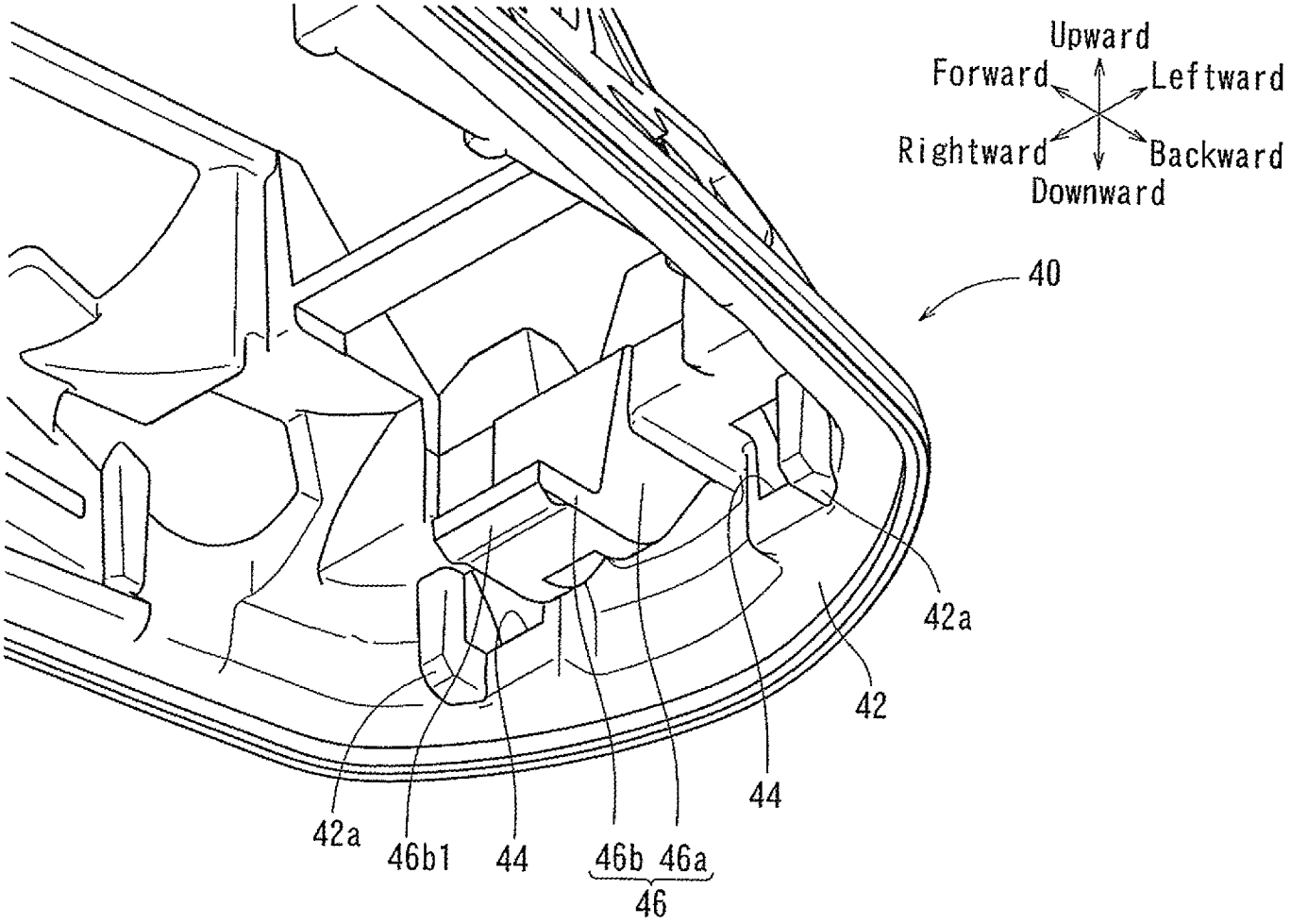
FIG. 4 is a partially enlarged perspective view of a pad of the antenna device.
Figure 6:
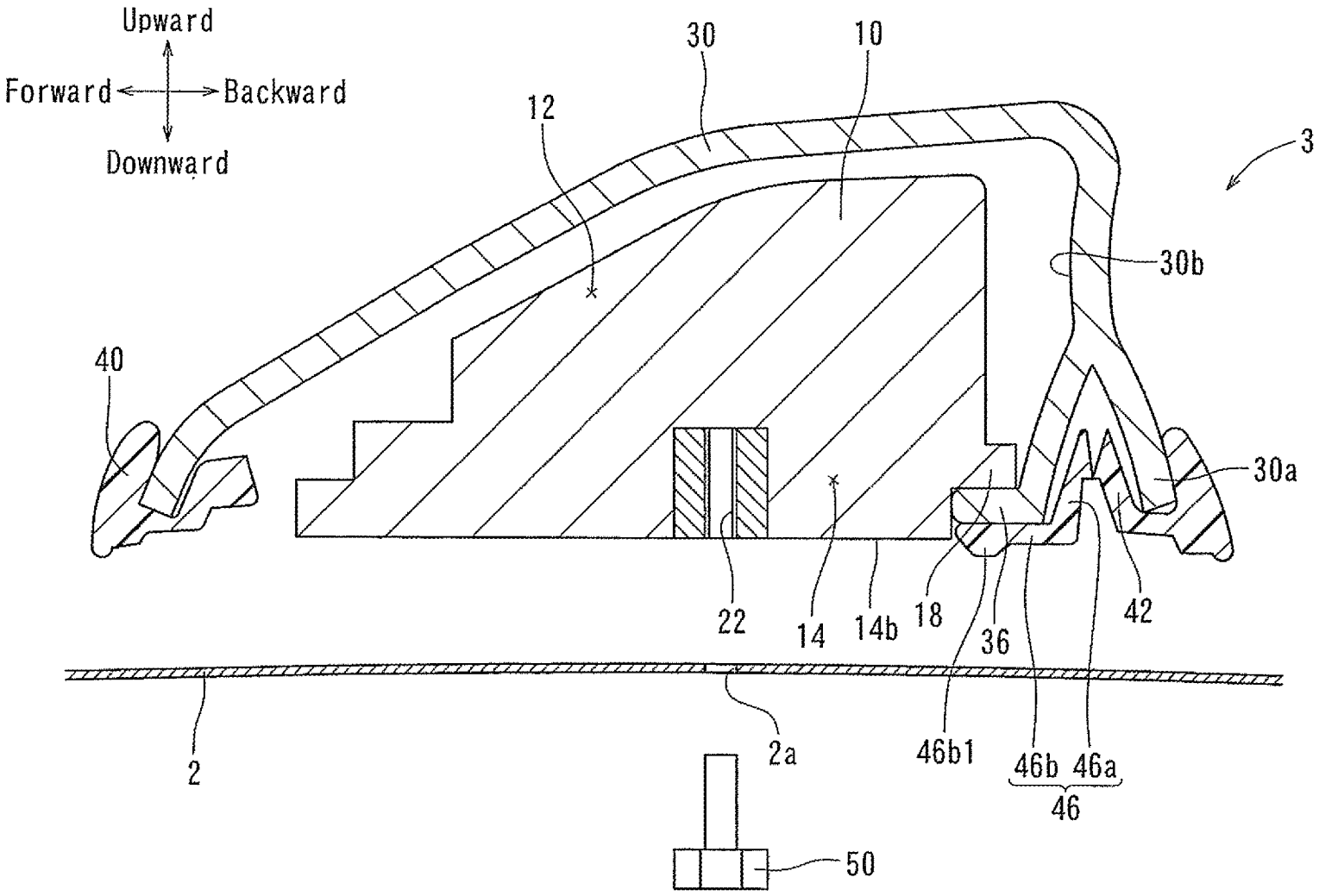
FIG. 6 is a schematically enlarged vertical cross-sectional view of FIG. 5.
Figure 8:
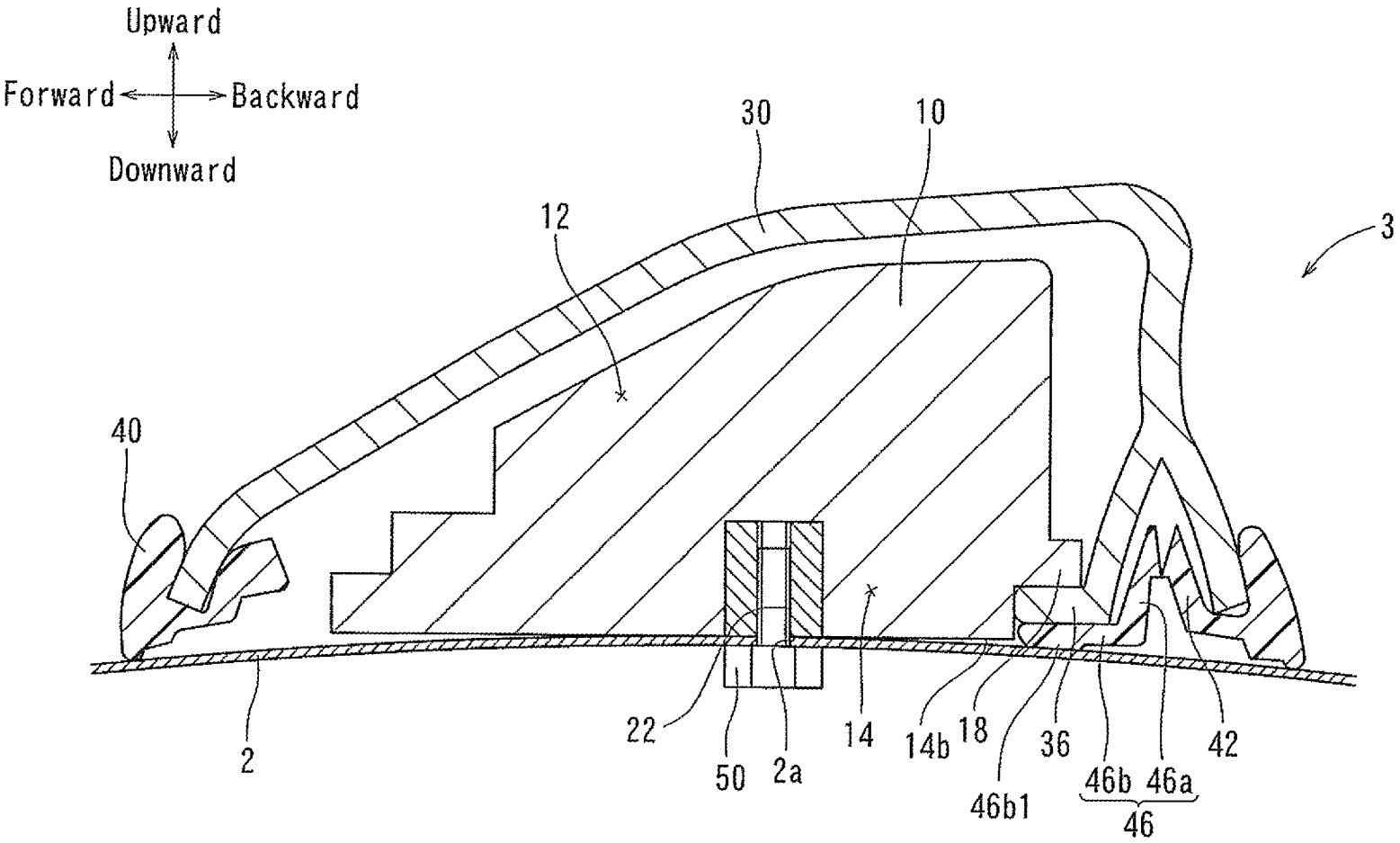
FIG. 8 is a schematically enlarged vertical cross-sectional view of FIG. 7.
Figure 9:
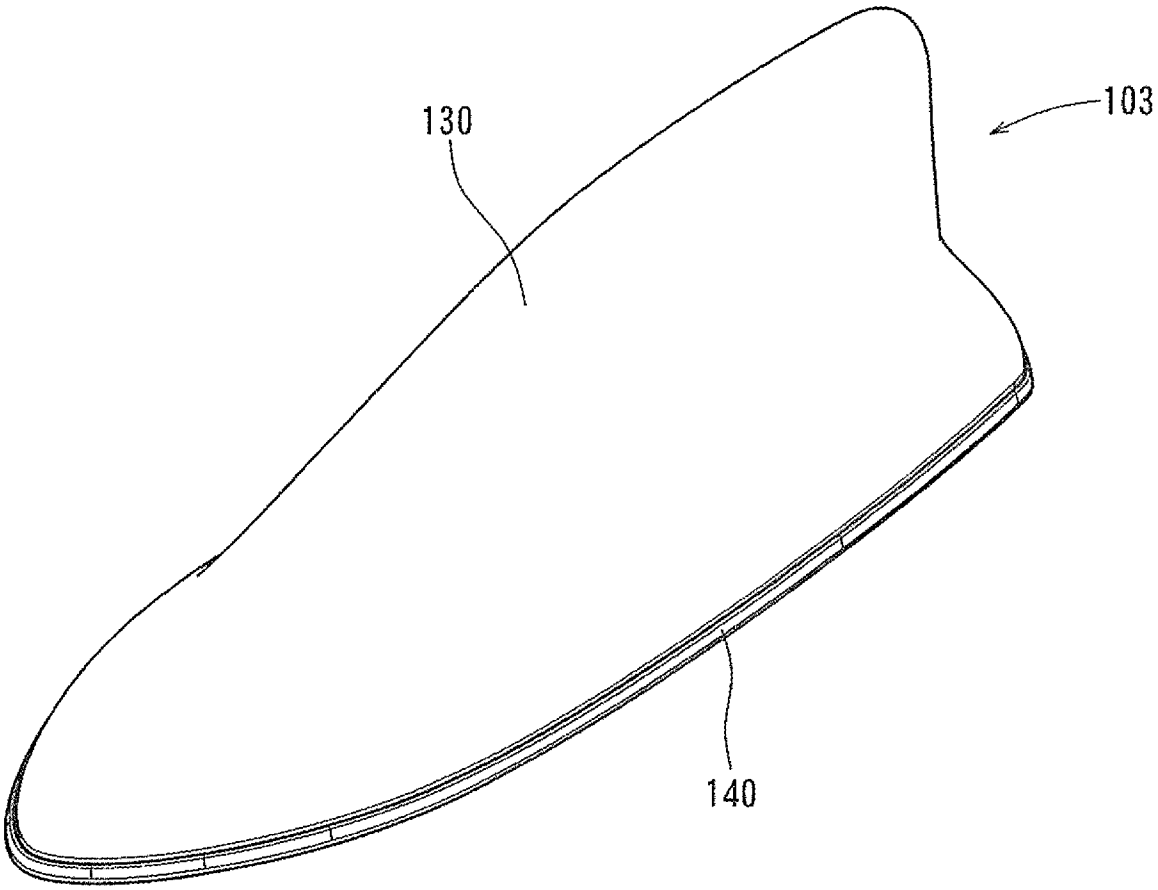
FIG. 9 PRIOR ART
FIG. 9 is a perspective view of a conventional antenna device, which is viewed from above.
Figure 10:
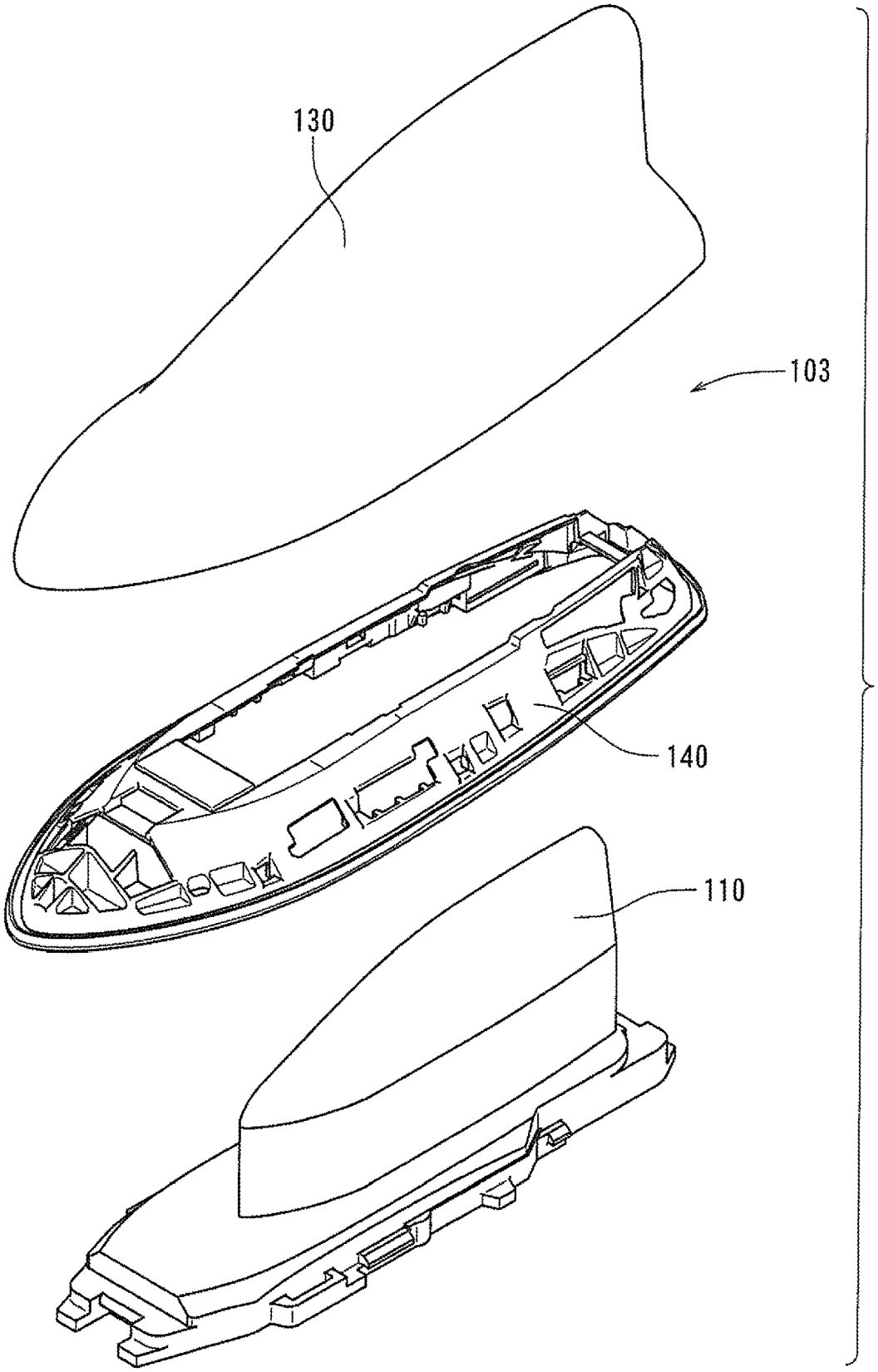
FIG. 10 PRIOR ART
FIG. 10 is an exploded perspective view of the antenna device, which is viewed from above.
Figure 11:
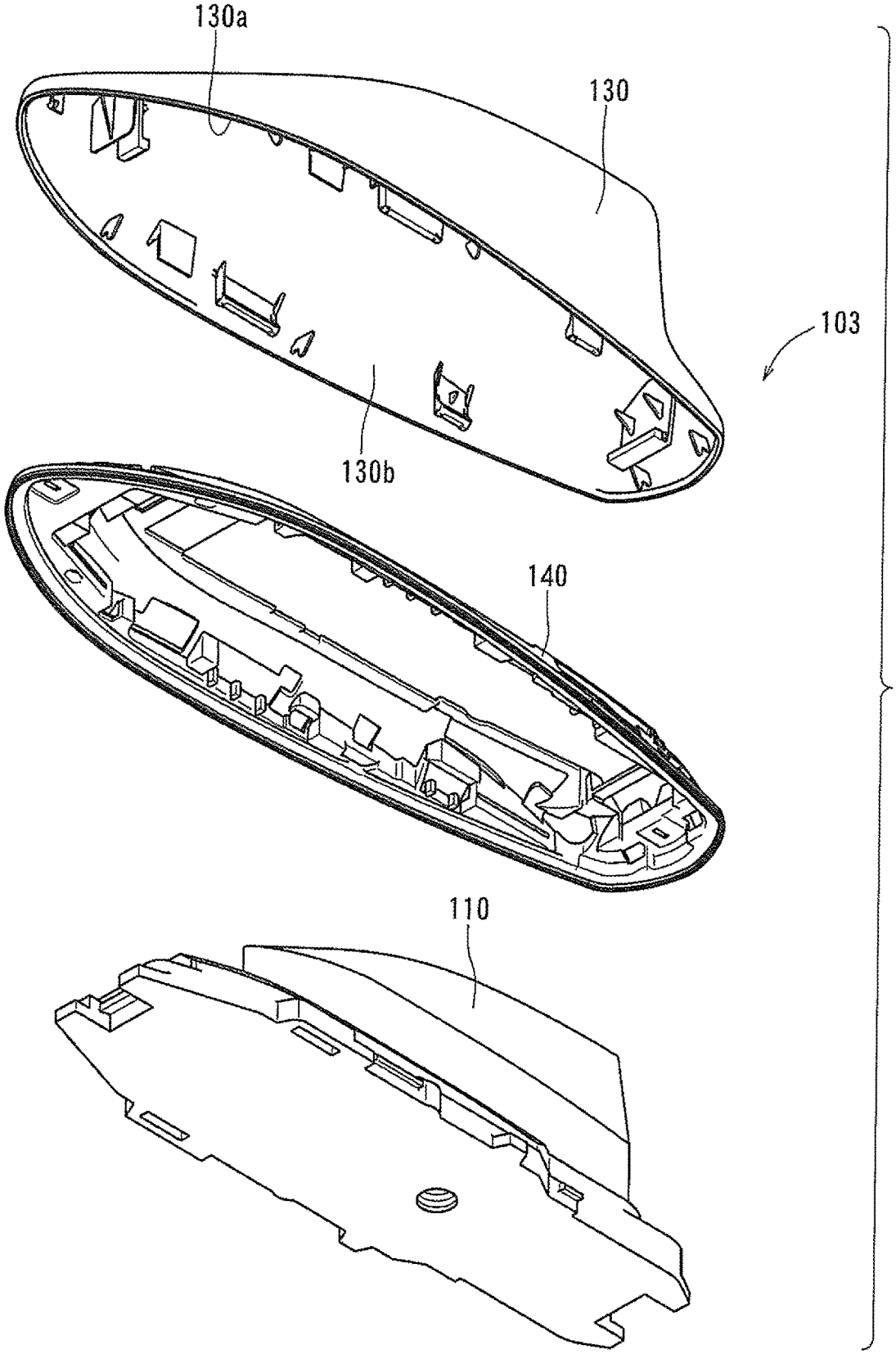
FIG. 11 PRIOR ART
FIG. 11 is an exploded perspective view of the antenna device, which is viewed from below.

As shown in FIG. 4, the pad 40 may have a postural adjusting member 46 integrally formed in the inner surface of the peripheral wall 42 thereof and having an L-shape in cross-section. Further, the postural adjusting member 46 may preferably be positioned in the back side of the peripheral wall 42 of the pad 40. The postural adjusting member 46 may be composed of a main portion 46*a* vertically suspended from the peripheral wall 42 and a substantially flat contact portion 46*b* horizontally extended forward from a distal end of the main portion 46*a*. As shown in FIGS. 6 and 8, the postural adjusting member 46 may be arranged and constructed such that the contact portion 46*b* may be positioned adjacent to the opening periphery 30*a* of the antenna cover 30 when the pad 40 is attached to the antenna cover 30. In particular, the postural adjusting member 46 may be arranged and constructed such that the contact portion 46*b* may be positioned beneath (outside) the engagement block 36 of the antenna cover 30 when the pad 40 is attached to the antenna cover 30. Further, the postural adjusting member 46 may be configured such that the contact portion 46*b* may protrude downward (outward) beyond the bottom surface 14*b* of the antenna substrate 14 of the antenna unit 10 when the antenna unit 10 is pressed into the antenna cover 30. Further, the contact portion 46*b* of the postural adjusting member 46 may have a projection 46*b*1 formed in a front end portion thereof and projected downward therefrom. Therefore, the contact portion 46*b* of the postural adjusting member 46 may face and contact the roof 2 via the projection 46*b*1 when the antenna device 3 is disposed on the roof 2.

An assembly process of the antenna device 3 composed of the antenna unit 10, the antenna cover 30 and the pad 40 will now be described with reference to FIGS. 1 to 3. First, the pad 40 may be combined with the antenna cover 30. In particular, the pad 40 may be fitted in the inner peripheral surface 30*b* of the opening periphery 30*a* of the antenna cover 30 while the six engagement slots 44 formed in the peripheral wall 42 of the pad 40 respectively engage the six engagement strips 32 formed in the inner peripheral surface 30*b* of the opening periphery 30*a* of the antenna cover 30. Thus, the pad 40 may be attached to the antenna cover 30. This operation (i.e., an attaching operation of the pad 40 to the antenna cover 30) may be referred to as a first assembly operation or step.

Next, in this condition, the antenna unit 10 may be attached to the antenna cover 30. In particular, the auxiliary engagement portion 18 formed in the antenna substrate 14 of the antenna unit 10 may be hooked on the engagement block 36 formed in the antenna cover 30, so as to form a pivotal engagement portion therein. Thereafter, the antenna unit 10 may be rotated with respect to the antenna cover 30 about the pivotal engagement portion until the (four) engagement claws 20 formed in the antenna substrate 14 of the antenna unite 10 respectively engage the (four) auxiliary engagement portions 38 formed in the antenna cover 30. Upon rotation of the antenna unit 10, the antenna unit 10 may be pressed against the antenna cover 30, so that the main engagement claw 34 formed in the antenna cover 30 may engage the main engagement portion 16 of the antenna unit 10. Thus, the antenna unit 10 may be attached to the antenna cover 30 with the pad 40 interleaved therebetween, so that the antenna device 3 may be assembled. This operation (i.e., an attaching operation of the antenna unit 10 to the antenna cover 30) may be referred to as a second assembly operation or step.

Figure 5:
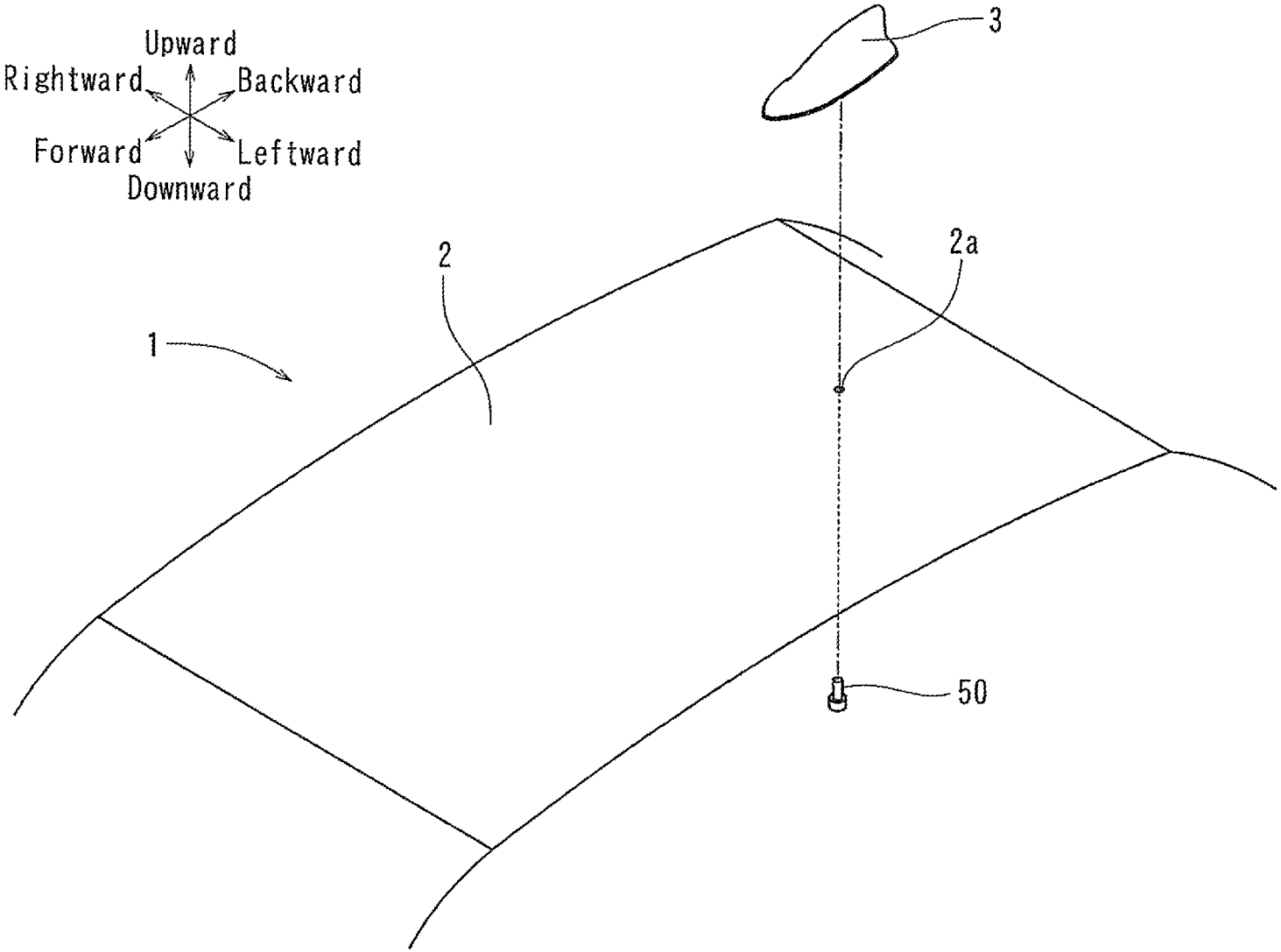
FIG. 5 is a perspective view of the antenna device, which shows a method of attaching the antenna device to a roof of a vehicle.
Figure 7:
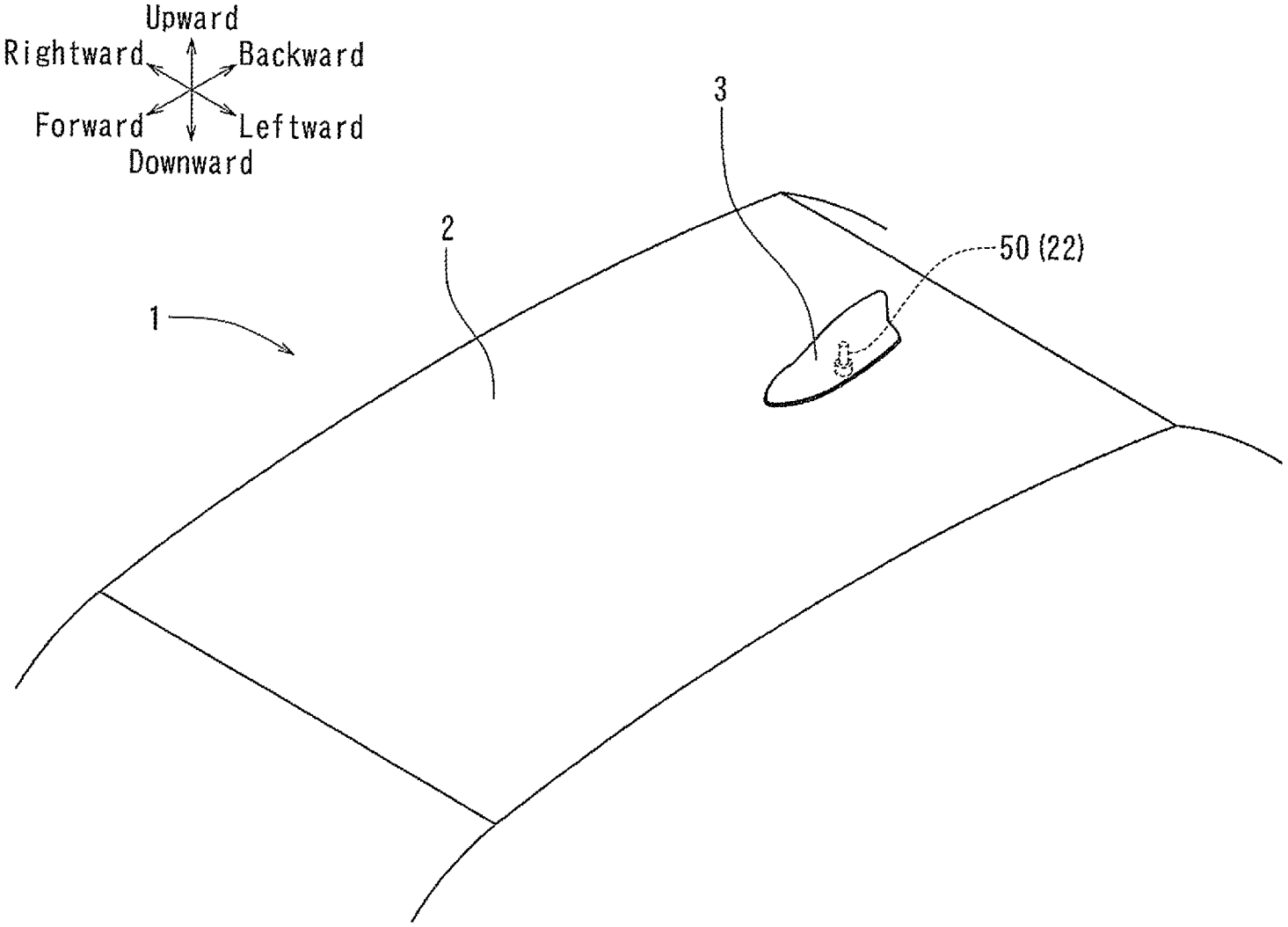
FIG. 7 is a perspective view of the antenna device, which shows a condition in which the antenna device is attached to the roof of the vehicle.

In the manner described, the antenna device 3 may be assembled through two assembly operations (the first and second assembly operations). As shown in FIGS. 5 to 8, the antenna device 3 thus assembled may be attached to the roof 2 of the automobile 1. In particular, the antenna device 3 may be positioned on the roof 2 with the bottom surface 14*b* of the antenna substrate 14 of the antenna unit 10 contacting the roof 2 while the threaded bore 22 formed in the antenna substrate 14 of the antenna unit 10 is aligned with an attachment hole 2*a* previously formed in the roof 2 (FIGS. 5 and 6). Subsequently, a fastening bolt 50 may be inserted into the attachment hole 2*a* from an interior side of the roof 2 and then be screwed or threaded into the threaded bore 22 (FIGS. 7 and 8). Thus, the fastening bolt 50 may be fixed or fastened to the threaded bore 22 through the attachment hole 2*a*, so that the antenna device 3 may be secured to the roof 2.

As shown in FIG. 8, when the fastening bolt 50 is threaded into (fastened to) the threaded bore 22, the pad 40 may elastically contact the roof 2 of the automobile 1 while the contact portion 46*b* (the projection 46*b*1) of the postural adjusting member 46 may elastically deformed or compressed. Therefore, even if a rear portion of the antenna cover 30 (a rear portion of the antenna unit 10) is relatively strongly pressed against the roof 2 (as compared to the front portion of the antenna cover 30) when the fastening bolt 50 is threaded into the threaded bore 22, the rear portion of the antenna cover 30 may be pushed up due to an elastic or restoring force (reactive force) of the deformed contact portion 46*b* of the postural adjusting member 46. As a result, a front portion of the antenna cover 30 (a front portion of the antenna unit 10) may be pressed downward, so as to be prevented from being spaced from the roof 2. That is, the antenna device 3 may be attached to the roof 2 without producing a clearance gap between the front portion of the antenna cover 30 and the roof 2. Thus, when the antenna device 3 is secured to the roof 2, the antenna cover 30 (the antenna unit 10) may be appropriately posturally adjusted due to the restoring force of the deformed contact portion 46*b* of the postural adjusting member 46. Therefore, the antenna device 3 attached to the roof 2 may have a good appearance.

Further, the contact portion 46*b* of the postural adjusting member 46 may have the projection 46*b*1 formed therein. Therefore, when the fastening bolt 50 is threaded into the threaded bore 22 in order to attach the antenna device 3 to the roof 2, the contact portion 46*b* of the postural adjusting member 46 may be reliably and effectively deformed or compressed via the projection 46*b*1. As a result, the restoring force of the contact portion 46*b* of the postural adjusting member 46 may be reliably and effectively applied to the antenna cover 30 (the antenna unit 10). Accordingly, the antenna device 3 of embodiments described herein may be reliably attached to the roof 2 of the automobile 1.

Various changes and modifications may be made to the present embodiment without departing from the scope of the teaching. For example, in the embodiment, the automobile 1 may be exemplified as the vehicle to which the antenna device 3 is attached. However, the antenna device 3 may be attached to various vehicles.

Further, in the embodiment, an engaging mechanism composed of the engagement slots 44 and the engagement strips 32 may be used in order to attach the pad 40 to the antenna cover 30. However, such an engaging mechanism may be replaced with various engaging mechanisms (e.g., an engaging mechanism composed of engagement projections and engagement hooks).

Further, in the embodiment, an engaging mechanism composed of a combination of the auxiliary engagement portion 18 and the engagement block 36, a combination of the engagement claws 20 and the auxiliary engagement portions 38, and a combination of the main engagement portion 16 and the main engagement claw 34 may be used in order to attach the antenna unit 10 to the antenna cover 30. However, such an engaging mechanism may be replaced with various engaging mechanisms.

Further, the number and the numeral value described therein may be changed as necessary.

Further, in the embodiment, the postural adjusting member 46 (the main portion 46*a*) may be positioned in the back side of the peripheral wall 42 of the pad 40. However, the position of the postural adjusting member 46 may be changed as necessary. That is, the postural adjusting member 46 may be formed in various portions (e.g., a right side and a left side) of the peripheral wall 42 of the pad 40.

A representative example of the present teaching has been described in detail with reference to the attached drawings. This detailed description is merely intended to teach a person of skill in the art further details for practicing preferred aspects of the present teaching and is not intended to limit the scope of the teaching. Only the claims define the scope of the claimed teaching. Therefore, combinations of features and steps disclosed in the foregoing detailed description may not be necessary to practice the teaching in the broadest sense, and are instead taught merely to particularly describe detailed representative examples of the teaching. Moreover, the various features taught in this specification may be combined in ways that are not specifically enumerated in order to obtain additional useful embodiments of the present teaching.

What is claimed is:

1. A vehicular antenna device, comprising:

an antenna unit configured to transmit and receive various electromagnetic waves or signals;

an antenna cover comprising a first end and a second end opposite the first end, wherein the antenna cover is configured to cover the antenna unit; and a pad attached to an inner peripheral surface of the antenna cover, wherein the antenna unit is attached to the antenna cover with the pad disposed therebetween, wherein the pad includes a postural adjusting member formed in a peripheral wall of the pad and projecting therefrom, wherein the postural adjusting member is positioned on only one end portion of the pad, and wherein the postural adjusting member is configured to be elastically compressed in a condition in which the antenna device is attached to a roof of a vehicle and to apply a reactive force to the second end of the antenna cover to press the first end of the antenna cover towards the roof of the vehicle.

2. The vehicular antenna device as defined in claim 1, wherein the postural adjusting member includes a contact portion configured to be elastically compressed in the condition in which the antenna device is attached to the roof.

3. The vehicular antenna device as defined in claim 2, wherein the contact portion includes a projection formed therein, and wherein the contact portion is configured to be elastically compressed via the projection in the condition in which the antenna device is attached to the roof.

* * * * *